US007637377B1

(12) United States Patent
Peckholdt, Jr.

(10) Patent No.: US 7,637,377 B1
(45) Date of Patent: Dec. 29, 2009

(54) STORAGE CONTAINER AND PLAY AREA COMBINATION KIT

(76) Inventor: Richard C. Peckholdt, Jr., 60 Finch La., Apartment 1A, Islip, NY (US) 11751

( * ) Notice: Subject to any disclaimer, the term of this patent is extended or adjusted under 35 U.S.C. 154(b) by 12 days.

(21) Appl. No.: 12/134,282

(22) Filed: Jun. 6, 2008

(51) Int. Cl.
*B65D 5/50* (2006.01)

(52) U.S. Cl. ..... 206/579; 446/75

(58) Field of Classification Search ..... 206/576, 206/577, 579, 315.1, 476; 446/75, 77
See application file for complete search history.

(56) References Cited

U.S. PATENT DOCUMENTS

| | | | | |
|---|---|---|---|---|
| 2,977,688 | A * | 4/1961 | Redey | 434/92 |
| 4,285,157 | A | 8/1981 | Lambert | |
| 4,349,983 | A | 9/1982 | Kilroy et al. | |
| 4,666,042 | A | 5/1987 | Dlott et al. | |
| 4,781,120 | A | 11/1988 | Farrow et al. | |
| 4,937,207 | A | 6/1990 | Simmell et al. | |
| 5,190,127 | A * | 3/1993 | Cummings | 190/102 |
| D349,633 | S | 8/1994 | Krupa | |
| D393,495 | S | 4/1998 | Blumenthal | |
| 5,931,099 | A | 8/1999 | Bruner et al. | |
| 5,984,755 | A * | 11/1999 | Avey | 446/75 |
| 6,491,562 | B1 * | 12/2002 | Jackson | 446/71 |
| 7,287,647 | B1 * | 10/2007 | Licciardi | 206/579 |

* cited by examiner

*Primary Examiner*—Jacob K Ackun, Jr.

(57) ABSTRACT

A storage container and play area combination kit includes a housing with a bottom wall and a perimeter wall. The perimeter wall has an upper edge defining an opening into the housing. A cover is pivotally coupled to the perimeter wall. A peripheral wall is attached to and extends upwardly from the cover. An upper wall is pivotally coupled to the peripheral wall. A dividing wall is attached to the peripheral wall and is spaced from and oriented parallel to the cover. A central compartment is defined between the dividing wall and the cover. The peripheral wall has a plurality of slots therein. A plurality of extension panels is positioned within the central compartment. The panels are extendable outwardly of the slots to define a play area backdrop having scene indicia thereon.

8 Claims, 7 Drawing Sheets

STORAGE CONTAINER AND PLAY AREA COMBINATION KIT

BACKGROUND OF THE INVENTION

Field of the Invention

The present invention relates to play kit devices and more particularly pertains to a new play kit device for providing a play area and means of transporting a plurality of toys.

SUMMARY OF THE INVENTION

The present invention meets the needs presented above by generally comprising a housing with a bottom wall and a perimeter wall that is attached to and extends upwardly from the bottom wall. The perimeter wall includes a front wall, a rear wall, a first lateral wall and a second lateral wall. The perimeter wall has an upper edge defining an opening into the housing. A cover is pivotally coupled to the rear wall and is selectively positioned in a closed position closing the opening or in an open position exposing the opening. A peripheral wall is attached to and extends upwardly from the cover. An upper wall is pivotally coupled to the peripheral wall to selectively cover or expose an interior space bounded by the peripheral wall. A dividing wall is attached to the peripheral wall and is spaced from and oriented parallel to the cover. A central compartment is defined between the dividing wall and the cover. The peripheral wall has a plurality of slots therein extending into the central compartment. A plurality of extension panels is positioned within the central compartment. Each of the extension panels includes a tab extending outwardly from one of the slots. The panels are slidable outwardly from the central compartment to define a play area backdrop having scene indicia thereon.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
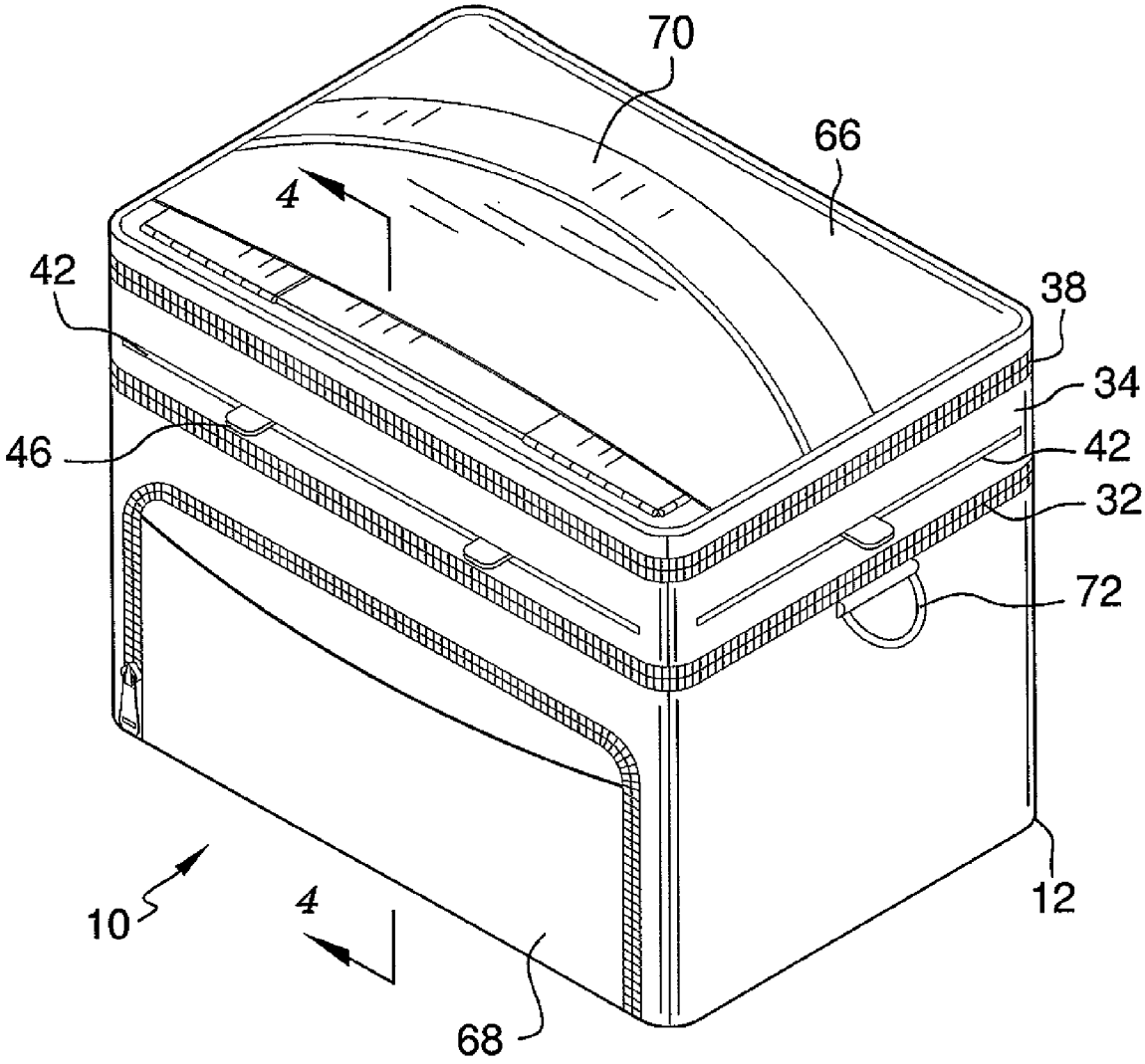
FIG. 1 is a front perspective view of a storage container and play area combination kit according to the present invention.
Figure 2:
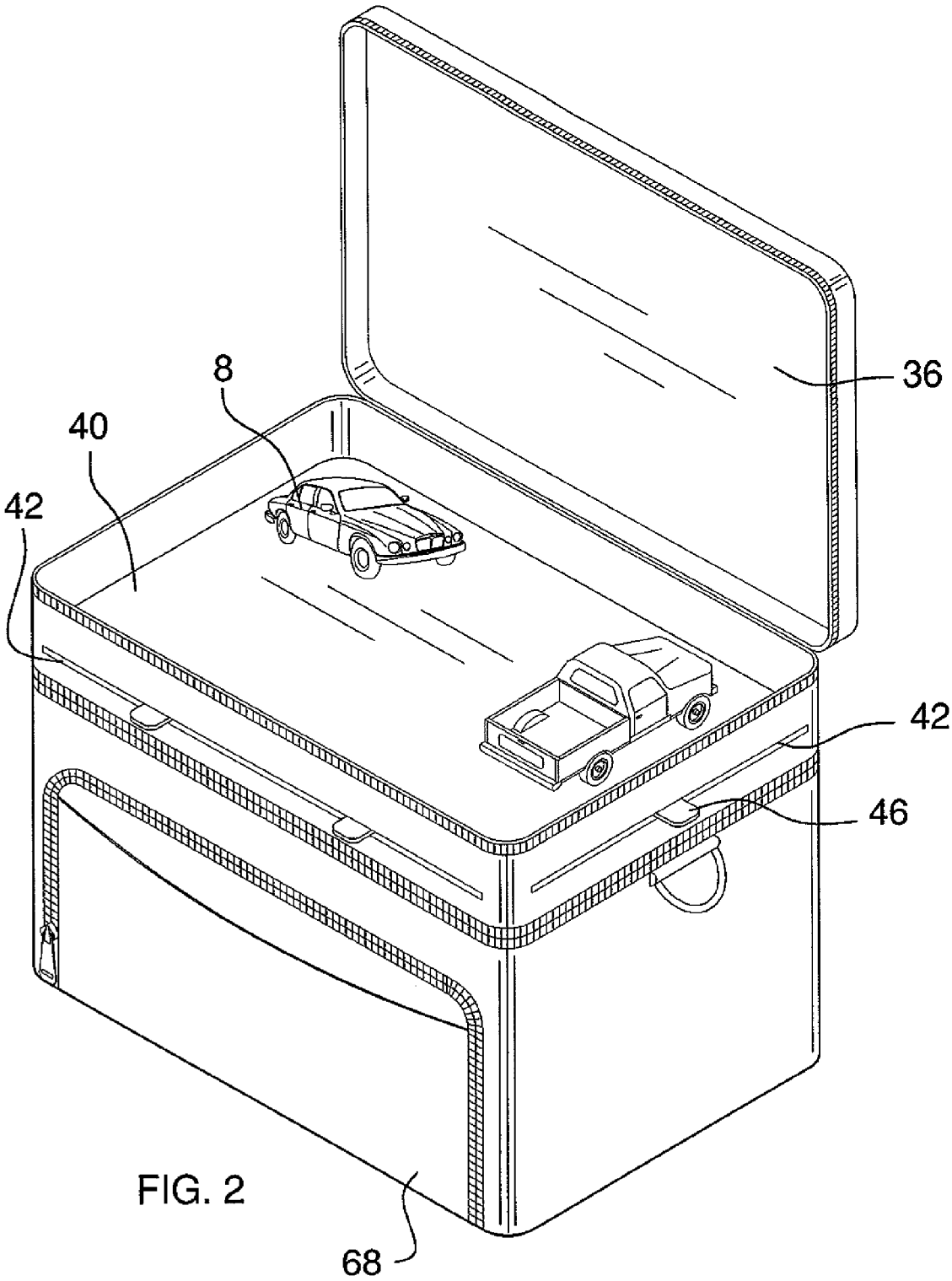
FIG. 2 is a front perspective view of the present invention.
Figure 3:
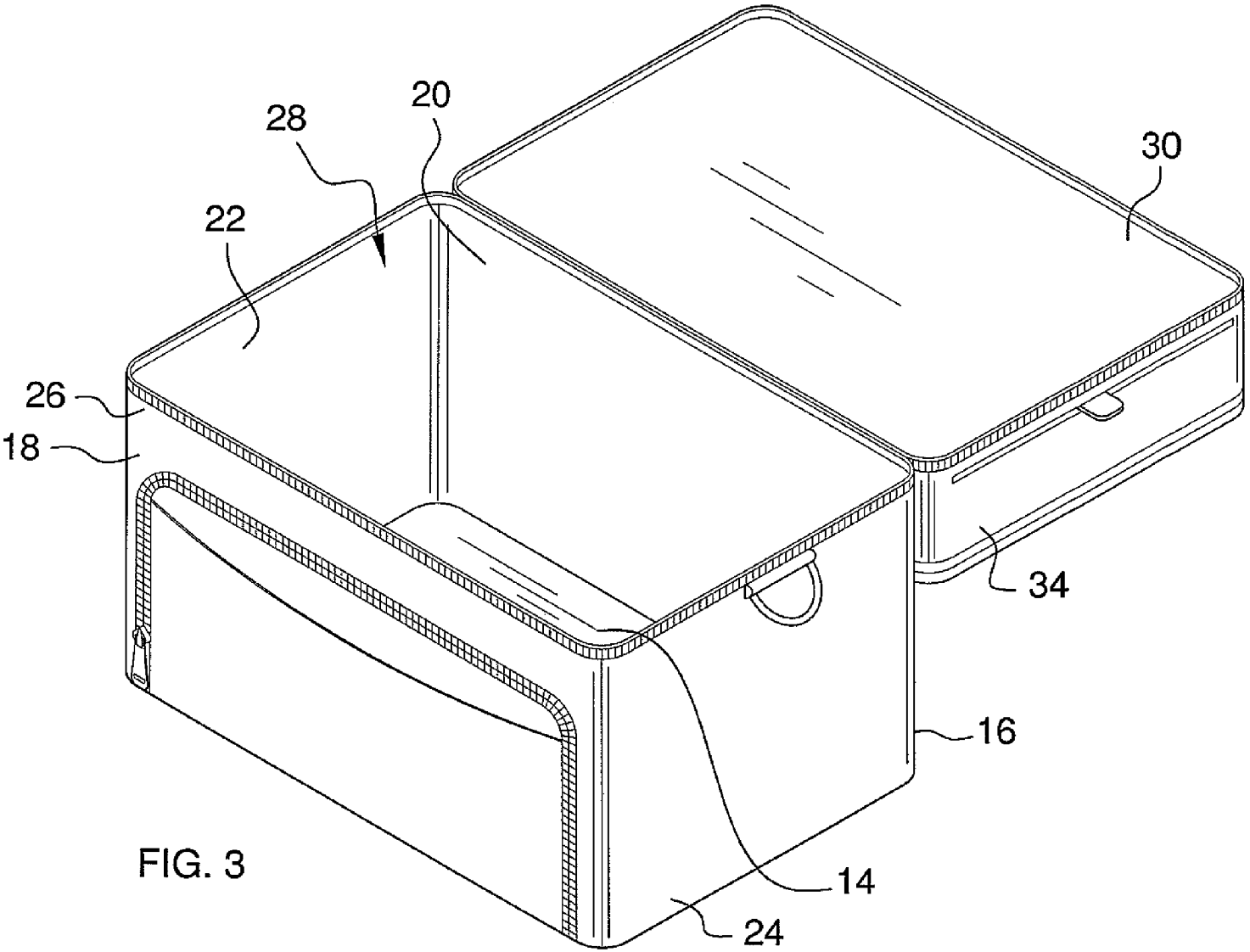
FIG. 3 is a front perspective view of the present invention.
Figure 4:
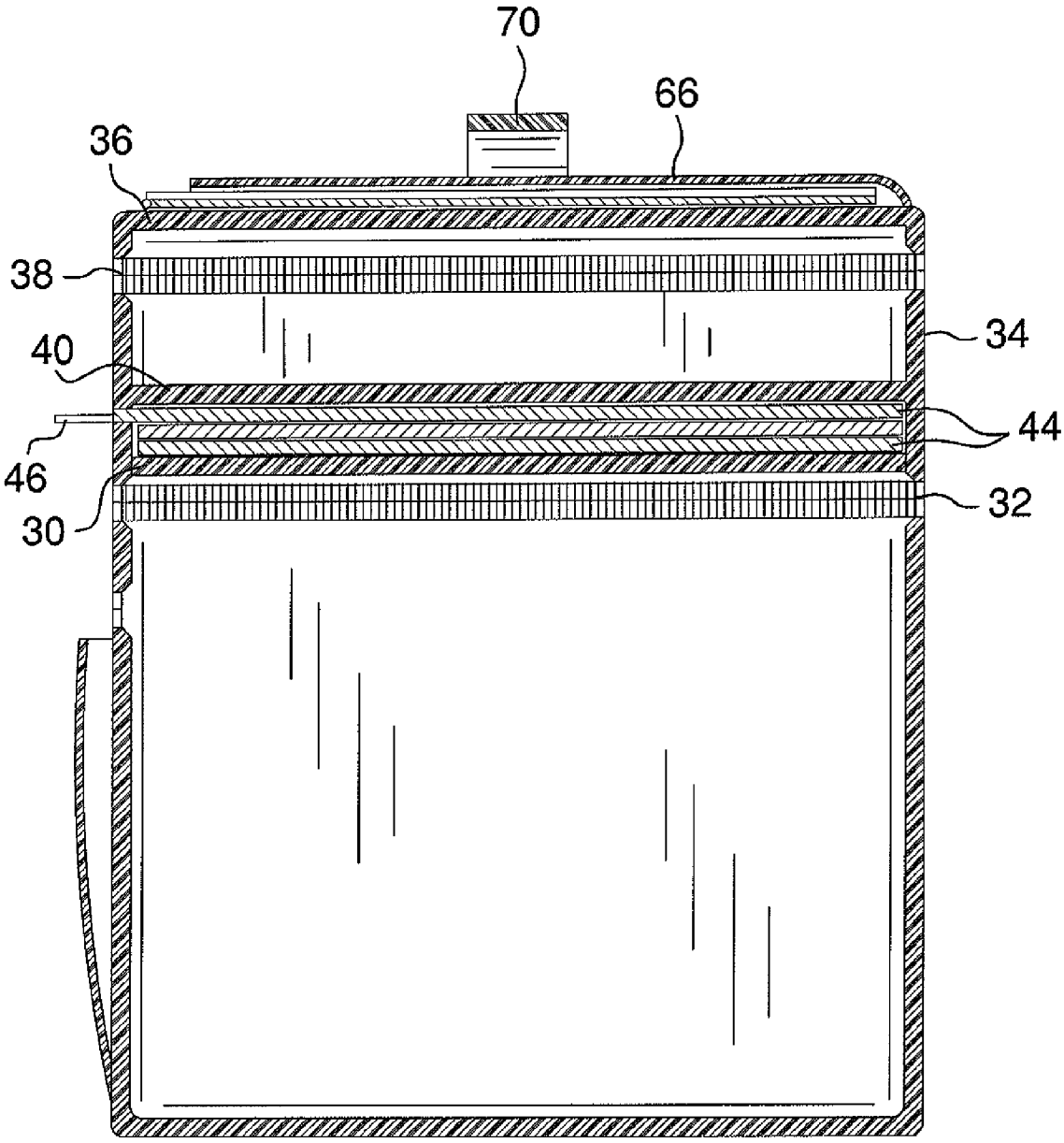
FIG. 4 is a cross-sectional view taken along line 4-4 of FIG. 1 of the present invention.

With reference now to the drawings, and in particular to FIGS. 1 through 7 thereof, a new play kit device embodying the principles and concepts of the present invention and generally designated by the reference numeral 10 will be described.

As best illustrated in FIGS. 1 through 7, the storage container and play area combination kit 10 generally comprises a housing 12 that has a bottom wall 14 and a perimeter wall 16, which is attached to and extends upwardly from the bottom wall 14. The perimeter wall 16 includes a front wall 18, a rear wall 20, a first lateral wall 22 and a second lateral wall 24. The perimeter wall 16 has an upper edge 26 defining an opening 28 into the housing 12. A cover 30 is pivotally coupled to the rear wall 20 and is selectively positioned in a closed position closing the opening 28 or in an open position exposing the opening 28. A closure 32 is attached to the perimeter wall 16 and the cover 30 to releasably secure the cover 30 in the closed position. The closure 32 comprises a zipper.

A peripheral wall 34 is attached to and extends upwardly from the cover 30. An upper wall 36 is pivotally coupled to the peripheral wall 34 to selectively cover or expose an interior space bounded by the peripheral wall 34. A closing member 38 is mounted on the peripheral wall 34 and the upper wall 36 to secure the upper wall 36 in a covering position covering the interior space. The closing member 38 comprises a zipper. A dividing wall 40 is attached to the peripheral wall 34 and is spaced from and oriented parallel to the cover 30. A central compartment is defined between the dividing wall 40 and the cover 30. The peripheral wall 34 has a plurality of slots 42 therein extending into the central compartment.

Figure 5:
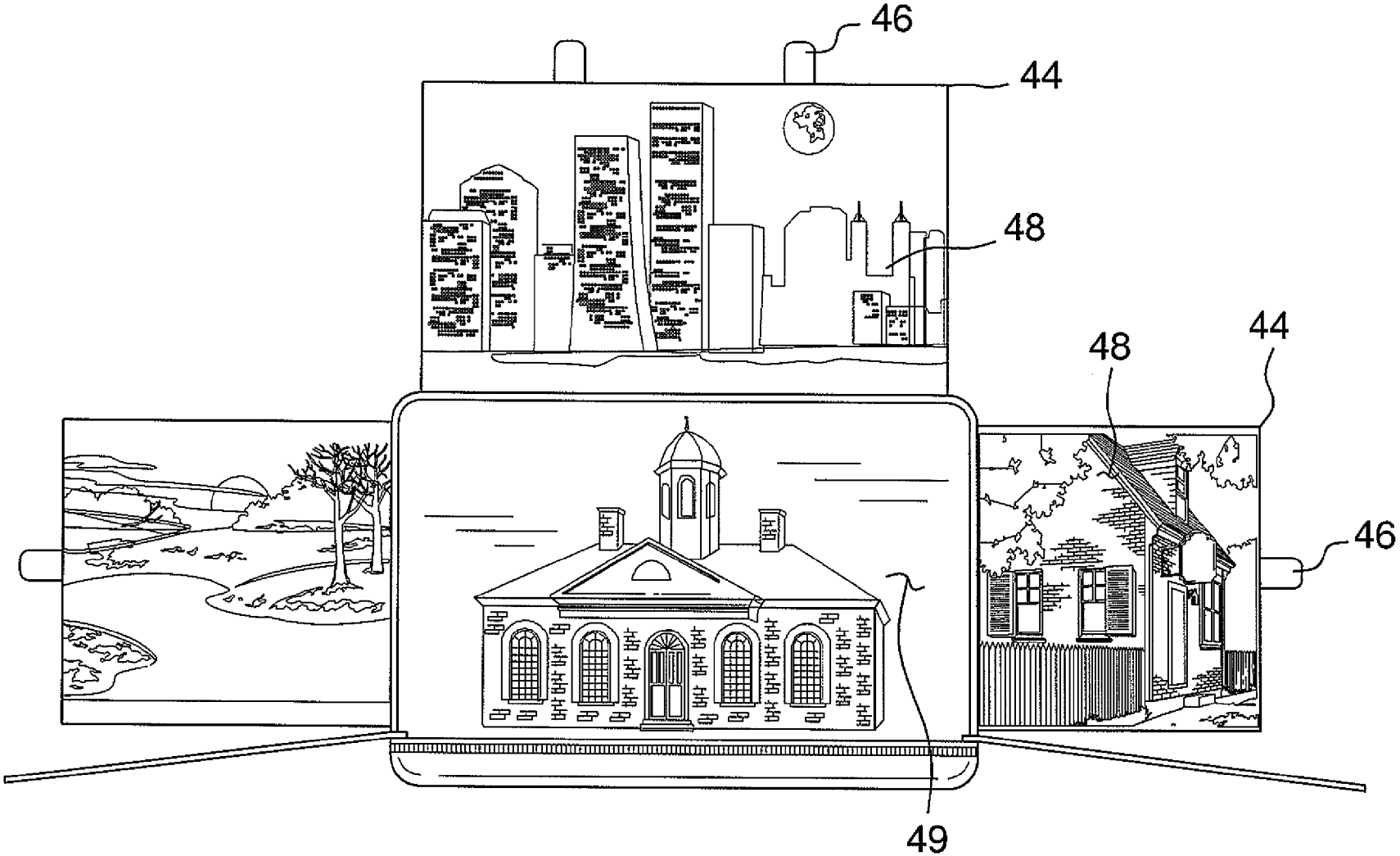
FIG. 5 is a front view of the present invention including scene indicia.
Figure 6:
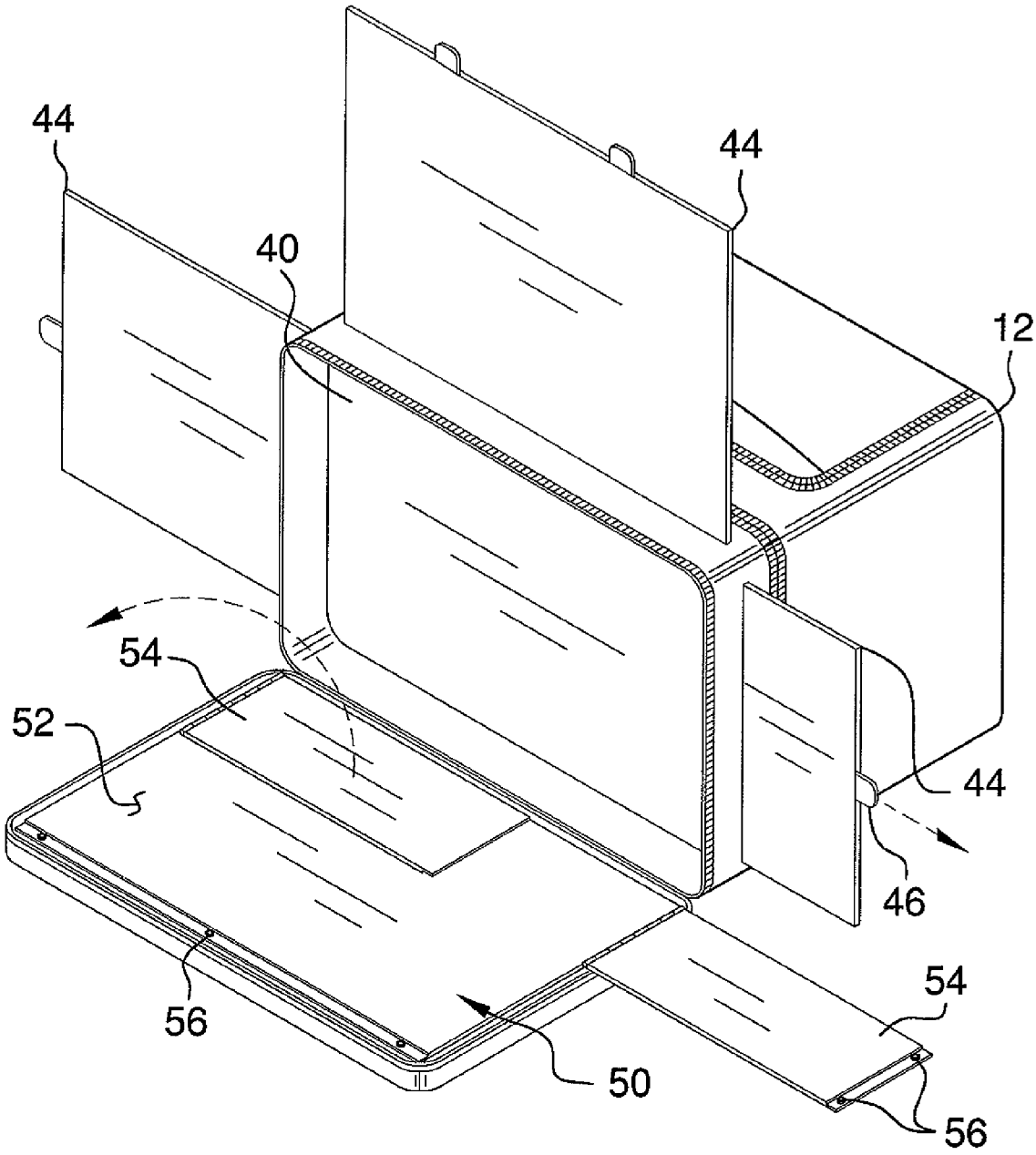
FIG. 6 is a front perspective view of the present invention.
Figure 7:
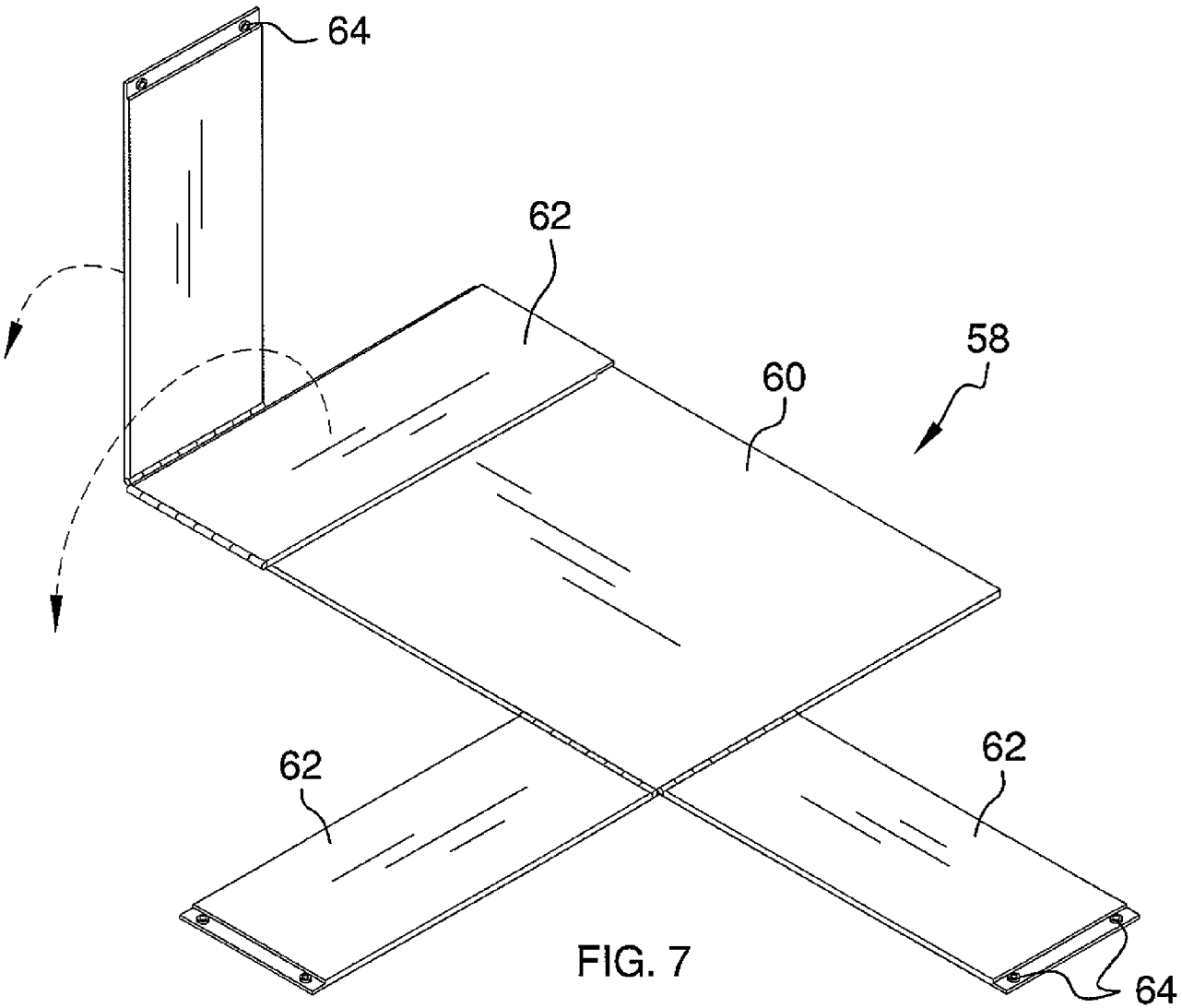
FIG. 7 is a top perspective view of a track extension of the present invention.

A plurality of extension panels 44 is positioned within the central compartment. Each of the extension panels 44 includes a tab 46 extending outwardly from one of the slots 42. The extension panels 44 are slidable outwardly from the central compartment to define a play area backdrop having scene indicia 48 thereon. FIG. 5 shows an example of the scene indicia 48 which may be used. Further, the dividing wall 40 may also include scene indicia 49. The extension panels 44 may be removed and replaced as desired to alter the backdrop being represented by the indicia 48.

A track mounting 50 is removably positioned over a bottom side of the upper wall 36. The track mounting 50 includes a primary plate 52 covering the bottom side of the upper wall 36 and a plurality of secondary plates 54 hingedly coupled to the primary plate 52. The secondary plates 54 are selectively folded outwardly from the upper wall 36. Each of primary 52 and secondary 54 plates each have first mating members 56 thereon.

A track extension 58 includes a plurality of tertiary plates hingedly coupled together. The tertiary plates include a central plate 60 and a plurality of peripheral plates 62 hingedly coupled to the central plate 60. Each of the peripheral plates 62 includes second mating members 64 that are releasably couplable with selected ones of the first mating members 56. The track extension 58 and the track mounting 50 may be used as roadways for toy vehicles 8.

An upper pocket 66 is attached to an upper side of the upper wall 36. The upper pocket 66 receives the track extension 58 to define a stored position of the track extension 58 when it is folded. A lateral pocket 68 is attached to the perimeter wall 16 of the housing 12 and a handle 70 is attached to the upper side of the upper wall 36. Loops 72 for attaching straps to the housing 12 are attached to the perimeter wall 16.

In use, the housing 12 is used for holding a plurality of toys, such as toy vehicles 8, action figures, play sets and the like. The tabs 46 may be used to pull out the extension panels 44 to form a play scene while the track extensions 58 and track mounting 50 used to expand a play area of the kit 10.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A play kit and container combination assembly comprising:

a housing having a bottom wall and a perimeter wall being attached to and extending upwardly from said bottom wall, said perimeter wall including a front wall, a rear wall, a first lateral wall and a second lateral wall, said perimeter wall having an upper edge defining an opening into said housing, a cover being pivotally coupled to said rear wall and being selectively positioned in a closed position closing said opening or in an open position exposing said opening;

a peripheral wall being attached to and extending upwardly from said cover, an upper wall being pivotally coupled to said peripheral wall to selectively cover or expose an interior space bounded by said peripheral wall, a dividing wall being attached to said peripheral wall and being spaced from and oriented parallel to said cover, a central compartment being defined between said dividing wall and said cover, said peripheral wall having a plurality of slots therein extending into said central compartment; and a plurality of extension panels being positioned within said central compartment, said panels being slidable outwardly from said central compartment to define a play area backdrop having scene indicia thereon.

2. The assembly according to claim 1, further including a closure being attached to said perimeter wall and said cover to releasably secure said cover in said closed position, a closing member being mounted on said peripheral wall and said upper wall to secure said upper wall in a covering position covering said interior space.

3. The assembly according to claim 1, further including a track mounting being removably positioned over a bottom side of said upper wall, said track mounting including a primary plate covering said bottom side and a plurality of secondary plates hingedly coupled to said primary plate, said secondary plates being selectively folded outwardly from said upper wall.

4. The assembly according to claim 3, further including:

each of primary and secondary plates having first mating members thereon;

a track extension including a plurality of tertiary plates hingedly coupled together, said tertiary plates including a central plate and a plurality of peripheral plates hingedly coupled to said central plate, each of said peripheral plates including second mating members being releasably couplable with selected ones of said first mating members.

5. The assembly according to claim 4, further including an upper pocket being attached to an upper side of said upper wall, said upper pocket receiving said track extension to define a stored position of said track extension.

6. The assembly according to claim 1, further including a lateral pocket being attached to said perimeter wall of said housing.

7. The assembly according to claim 1, further including a handle being attached to said upper side of said upper wall.

8. A play kit and container combination assembly comprising:

a housing having a bottom wall and a perimeter wall being attached to and extending upwardly from said bottom wall, said perimeter wall including a front wall, a rear wall, a first lateral wall and a second lateral wall, said perimeter wall having an upper edge defining an opening into said housing, a cover being pivotally coupled to said rear wall and being selectively positioned in a closed position closing said opening or in an open position exposing said opening, a closure being attached to said perimeter wall and said cover to releasably secure said cover in said closed position;

a peripheral wall being attached to and extending upwardly from said cover, an upper wall being pivotally coupled to said peripheral wall to selectively cover or expose an interior space bounded by said peripheral wall, a closing member being mounted on said peripheral wall and said upper wall to secure said upper wall in a covering position covering said interior space, a dividing wall being attached to said peripheral wall and being spaced from and oriented parallel to said cover, a central compartment being defined between said dividing wall and said cover, said peripheral wall having a plurality of slots therein extending into said central compartment;

a plurality of extension panels being positioned within said central compartment, each of said extension panels including a tab extending outwardly from one of said slots, said panels being slidable outwardly from said central compartment to define a play area backdrop having scene indicia thereon;

a track mounting being removably positioned over a bottom side of said upper wall, said track mounting including a primary plate covering said bottom side and a plurality of secondary plates hingedly coupled to said primary plate, said secondary plates being selectively folded outwardly from said upper wall, each of primary and secondary plates having first mating members thereon;

a track extension including a plurality of tertiary plates hingedly coupled together, said tertiary plates including a central plate and a plurality of peripheral plates hingedly coupled to said central plate, each of said peripheral plates including second mating members being releasably couplable with selected ones of said first mating members;

an upper pocket being attached to an upper side of said upper wall, said upper pocket receiving said track extension to define a stored position of said track extension;

a lateral pocket being attached to said perimeter wall of said housing; and a handle being attached to said upper side of said upper wall.

* * * * *